US007739113B2

(12) United States Patent
Kaneyasu

(10) Patent No.: US 7,739,113 B2
(45) Date of Patent: Jun. 15, 2010

(54) VOICE SYNTHESIZER, VOICE SYNTHESIZING METHOD, AND COMPUTER PROGRAM

(75) Inventor: Tsutomu Kaneyasu, Tokyo (JP)

(73) Assignee: Oki Electric Industry Co., Ltd., Tokyo (JP)

( * ) Notice: Subject to any disclaimer, the term of this patent is extended or adjusted under 35 U.S.C. 154(b) by 839 days.

(21) Appl. No.: 11/594,977

(22) Filed: Nov. 9, 2006

(65) Prior Publication Data

US 2007/0112570 A1 May 17, 2007

(30) Foreign Application Priority Data

Nov. 17, 2005 (JP) ..... 2005-332354

(51) Int. Cl.
*G10L 13/08* (2006.01)
*G10L 13/06* (2006.01)

(52) U.S. Cl. ..... 704/260; 704/267; 704/268

(58) Field of Classification Search ..... None
See application file for complete search history.

(56) References Cited

U.S. PATENT DOCUMENTS 5,940,797 A * 8/1999 Abe ..... 704/260
6,332,121 B1 * 12/2001 Kagoshima et al. ..... 704/262
7,280,968 B2 * 10/2007 Blass ..... 704/266

FOREIGN PATENT DOCUMENTS

JP 62-174800 A 7/1987
JP 11-052987 A 2/1999

OTHER PUBLICATIONS

Toshio Hirai et al., "A new ATR Speech Synthesis System: XIMERA", in The Institute of Electronics, Information and Communication Engineers, Technical Report, SP2005-18, p. 37-42 (May 2005).

* cited by examiner

*Primary Examiner*—Matthew J Sked
(74) *Attorney, Agent, or Firm*—Rabin & Berdo, PC

(57) ABSTRACT

A voice synthesizer includes a recorded voice storage portion (124) that stores recorded voices that are pre-recorded; a voice input portion (110) that is input with a reading voice reading out a text that is to be generated by the synthesized voice; an attribute information input portion (112) that is input with a label string, which is a string of labels assigned to each phoneme included in the reading voice, and label information, which indicates the border position of each phoneme corresponding to each label; a parameter extraction portion (116) that extracts characteristic parameters of the reading voice based on the label string, the label information, and the reading voice; and a voice synthesis portion (122) that selects the recorded voices from the recorded voice storage portion in accordance with the characteristic parameters, synthesizes the recorded voices, and generates the synthesized voice that reads out the text.

8 Claims, 13 Drawing Sheets

FIG.2

| | | | | | | | |
|---|---|---|---|---|---|---|---|
| 1120 LABEL STRING | M | U | K | A | SH | I |
| 1122 LABEL INFORMATION | 200 | 150 | 25 | 300 | 110 | 130 |

VOICE SYNTHESIZER, VOICE SYNTHESIZING METHOD, AND COMPUTER PROGRAM

CROSS REFERENCE TO RELATED APPLICATIONS

The disclosure of Japanese Patent Application No. JP-A-2005-332354 filed on Nov. 17, 2005 including the specification, drawings and abstract is incorporated herein by reference in its entirety.

BACKGROUND OF THE INVENTION

1. Field of the Invention

The present invention relates to a voice synthesizer, a voice synthesizing method, and a computer program. More particularly, the present invention relates to a voice synthesizer, a voice synthesizing method and a computer program that use recorded voices that are pre-recorded to generate a synthesized voice that reads out a text.

2. Description of the Related Art

Voice synthesizers are known that use a pre-recorded human natural voice to convert a text document that is input into a personal computer (PC) or the like in to a voice that reads out the text document. This type of voice synthesizer synthesis a voice based on a voice corpus including recorded natural voices that can be split into parts of speech.

In this voice synthesizer, first, for example, morphological analysis and modification analysis are performed on the input text in order to convert the text in to phonemic symbols, accent symbols and the like. Next, the phonemic symbols, an accent symbol string, and part of speech information for the input text obtained from the modification analysis results are used to estimate prosody parameters such as phoneme duration (voice length), fundamental frequency (voice pitch), power of the vowel center (voice strength) and the like. Then, dynamic programming is used to select the combination of synthesis units that have the smallest possible distortion when the synthesis units (phonemes) that are closest to the estimated prosody parameter and that are stored in the waveform dictionary are connected.

The prosody parameters are related to the intonation, accent, and the like of the synthesized voice when it reads out a text. With known voice synthesizers, since the voice is synthesized based on the prosody parameters estimated from the analysis results of the text as described above, it is difficult to generate a synthesized voice that has an intonation, accent, and the like that satisfies the user's expectations. To address this difficulty, in order to generate a synthesized voice having an intonation, accent, and the like that satisfy the user's expectations, a device has been proposed that synthesizes a voice based on prosody parameters that have been specified by the user using a graphical user interface (GUI).

For an example of such art refer to "A Corpus-based Speech Synthesis System", in The Institute of Electronics, Information and Communication Engineers, Technical Report, SP2005-18, p. 37-42 (2005, 5).

However, with the above art, there are many occasions when it difficult for a general user to understand which prosody parameters should be set to which values in order to generate a desired intonation. Thus, with a device like that above in which the prosody parameters are specified, it is difficult for a general user to generate a synthesized voice that has an intonation and the like that satisfies the user's expectations.

SUMMARY OF THE INVENTION

The present invention has been devised in light of the above problems, and it is an object thereof to provide a new and innovative voice synthesizer, a voice synthesizing method, and a computer program that allow a general user to easily generate a synthesized voice that has a desired intonation and accent.

In order to solve the above problems, one aspect of the present invention provides a voice synthesizer that uses recorded voices that are pre-recorded to generate a synthesized voice that reads out a text. The voice synthesizer includes a recorded voice storage portion that stores the recorded voices that are pre-recorded; a voice input portion that is input with a reading voice that is a natural voice reading out a text that is to be generated by the synthesized voice; and an attribute information input portion that is input with a label string and label information. The label string is a string of labels that are respectively assigned to each phoneme included in the reading voice and that are placed in a time series, and the label information indicates the border position of each phoneme corresponding to each label. The voice synthesizer also includes a parameter extraction portion that extracts a characteristic parameter that indicates a characteristic of the reading voice based on the label string, the label information, and the reading voice; and a voice synthesis portion that selects at least one of the recorded voices from the recorded voice storage portion in accordance with the characteristic parameter, synthesizes the selected at least one recorded voice, and generates the synthesized voice that reads out the text.

According to the above invention, the characteristic parameter that indicates the characteristic of the voice is extracted from the reading voice that is the natural voice reading out the text that is to be generated by the synthesized voice. Then, a recorded voice is selected in accordance with the extracted characteristic parameter. Accordingly, a recorded voice is selected that has similar characteristics to those of the natural voice, and this recorded voice is synthesized to generate the synthesized voice. Therefore, the user can generate a synthesized voice that is similar to the natural voice by inputting a natural voice, which reads out the text that is to be generated by synthesized voice, in to the voice synthesizer according to the present invention.

The characteristic parameter extracted by the parameter extraction portion may include an acoustic parameter that indicates an acoustic characteristic of the reading voice, and a prosody parameter that indicates a prosody characteristic of the reading voice. The acoustic characteristic may include spectrum, cepstrum, delta cepstrum, delta-delta cepstrum, power, delta power, delta-delta power, and combinations thereof. The prosody characteristic may include fundamental frequency (voice pitch), power of the vowel center (voice strength), and phoneme duration. According to the above described structure, a synthesized voice can be generated that has an acoustic characteristic and a prosody characteristic that are the same as or similar to those of the input nature voice.

The characteristic parameter extracted by the parameter extraction portion may include a prosody parameter that indicates a prosody characteristic of the reading voice. In addition, the voice synthesizer may further include: a phoneme model storage portion that stores an acoustic model and a prosody model that are generated in advance based on the recorded voices stored in the recorded voice storage portion. The acoustic model models an acoustic characteristic of each phoneme included in the recorded voices, and the prosody model models a prosody characteristic of each phoneme included in the recorded voices. Further, the voice synthesizer may further include: a text input portion that is input with a text that is to be generated by the synthesized voice; a text analysis portion that analyses the text and obtains language prosody information; and a characteristic estimation portion that estimates an acoustic characteristic of the natural voice reading out the text based on the label string, the label information, the prosody parameter, the language prosody information, and the acoustic model and the prosody model stored in the phoneme model storage portion, and derives an acoustic parameter that indicates the acoustic characteristic. The language prosody information may include, for example, part of speech or accent information. According to the above structure, the acoustic model that models the acoustic characteristic of the recorded voices and the prosody model that models the prosody characteristic of the recorded voices are used to estimate the acoustic characteristic that the synthesized voice needs to have. In other words, an acoustic model that models the acoustic characteristics of the voices of the speakers of the recorded voices is used to estimate differences in acoustic characteristics that vary depending on the speaker. Thus, the synthesized voice can be inhibited from sounding unnatural even if the speaker of the input natural voice and the speakers of the recorded voices are different.

The voice synthesizer may further include an individual label acoustic model storage portion that stores respective individual label acoustic models for each label that model the acoustic characteristic of each phoneme corresponding to each label; and a label information derivation portion that derives label information based on the reading voice, the label string, and the individual label acoustic models. According to this structure, the voice synthesizer derives the label information and thus the user does not need to create the label information. Thus, the synthesized voice can be generated more easily.

In order to solve the above problems, another aspect of the present invention provides a computer program that directs a computer to function as the above voice synthesizer. The computer program is stored in a memory provided in the computer, and is read and executed by a CPU provided in the computer, thereby directing the computer to function as the voice synthesizer. In addition, the present invention also provides a recording medium that can be read by a computer and on which the computer program is recorded. The recording medium may be a magnetic disk, an optical disk, or the like.

In order to solve the above problems, yet another aspect of the present invention provides a voice synthesizing method that uses recorded voices that are pre-recorded to generate a synthesized voice that reads out a text. The method includes the steps of: inputting a reading voice that is a natural voice reading out a text that is to be generated by the synthesized voice; and inputting attribute information that includes a label string and label information. The label string is a string of labels that are respectively assigned to each phoneme included in the reading voice and that are placed in a time series, and the label information indicates the border position of each phoneme corresponding to each label. The method also includes the steps of: extracting a characteristic parameter that indicates a characteristic of the reading voice based on the label string, the label information, and the reading voice; selecting at least one of the recorded voices in accordance with the characteristic parameter from a recorded voice storage portion that stores the recorded voices that are pre-recorded; and generating the synthesized voice that reads out the text by synthesizing the at least one recorded voice selected in the selection step.

In order to solve the above problems, yet another aspect of the present invention provides a voice synthesizer that uses recorded voices that are pre-recorded to generate a synthesized voice that reads out a text. This voice synthesizer includes: a recorded voice storage portion that stores the recorded voices that are pre-recorded; and a phoneme model storage portion that stores an acoustic model and a prosody model that are generated in advance based on the recorded voices stored in the recorded voice storage portion. The acoustic model models an acoustic characteristic of each phoneme included in the recorded voices, and the prosody model models a prosody characteristic of each phoneme included in the recorded voices. The voice synthesizer also includes: a text input portion that is input with a text that is to be generated by the synthesized voice; and an attribute information input portion that is input with a label string and label information. The label string is a string of labels that are respectively assigned to each phoneme included in the reading voice and that are placed in a time series, and the label information indicates the border position of each phoneme corresponding to each label. The voice synthesizer also includes a label information adjustment portion that sets, in accordance with a plurality of metrically and/or acoustically different states of each phoneme, the border position of each state; a text analysis portion that analyses the text and obtains language prosody information; a characteristic estimation portion that estimates a characteristic of the natural voice reading out the text based on the label string, the label information adjusted by the label information adjustment portion, the language prosody information, and the acoustic model and the prosody model stored in the phoneme model storage portion, and derives a characteristic parameter that indicates the characteristic; and a voice synthesis portion that selects at least one of the recorded voices from the recorded voice storage portion in accordance with the characteristic parameter, synthesizes the selected at least one recorded voice, and generates the synthesized voice that reads out the text.

The plurality of metrically and/or acoustically different states of each phoneme may be states determined in accordance with a hidden Markov model (HMM). According to the above invention, the user can set the border position of each state for each phoneme. Thus, the prosody of each phoneme can be set precisely, thereby allowing subtle adjustment of the intonation and the like of the generated synthesized voice.

The above label information may indicate a duration of each phoneme corresponding to each label, and the label information adjustment portion may assign the durations to each state in correspondence with the plurality of states.

In order to solve the above problems, yet another aspect of the present invention provides a computer program that directs a computer to function as the above voice synthesizer.

In order to solve the above problem, yet still another aspect of the present invention provides a voice synthesizing method that uses recorded voices that are pre-recorded to generate a synthesized voice that reads out a text. The method uses: a recorded voice storage portion that stores the recorded voices that are pre-recorded; and a phoneme model storage portion that stores an acoustic model and a prosody model that are generated in advance based on the recorded voices stored in the recorded voice storage portion. The acoustic model models an acoustic characteristic of each phoneme included in the recorded voices, and the prosody model models a prosody characteristic of each phoneme included in the recorded voices. The method includes the steps of: inputting a text that is to be generated by the synthesized voice; and inputting attribute information that includes a label string and label information. The label string is a string of labels that are respectively assigned to each phoneme included in the text and that are placed in a time series, and the label information indicates the border position of each phoneme corresponding to each label. The method also includes the steps of: adjusting the label information by setting, in accordance with a plurality of metrically and/or acoustically different states of each phoneme, the border position of each state; analyzing the text and obtaining language prosody information; estimating a characteristic of the natural voice reading out the text based on the label string, the label information adjusted by the label information adjustment step, the language prosody information, and the acoustic model and the prosody model stored in the phoneme model storage portion, and deriving a characteristic parameter that indicates the characteristic; and generating the synthesized voice that reads out the text by selecting at least one of the recorded voices from the recorded voice storage portion in accordance with the characteristic parameter and synthesizing the selected at least one recorded voice.

According to the invention described above, a voice synthesizer, a voice synthesizing method, and a computer program are provided that allow even a general user to easily generate a synthesized voice that has a desired intonation and accent.

BRIEF DESCRIPTION OF THE DRAWINGS

FIG. 2 is an explanatory diagram showing a label string and label information according to the first embodiment;

DETAILED DESCRIPTION OF THE PREFERRED EMBODIMENTS

Figure 1:
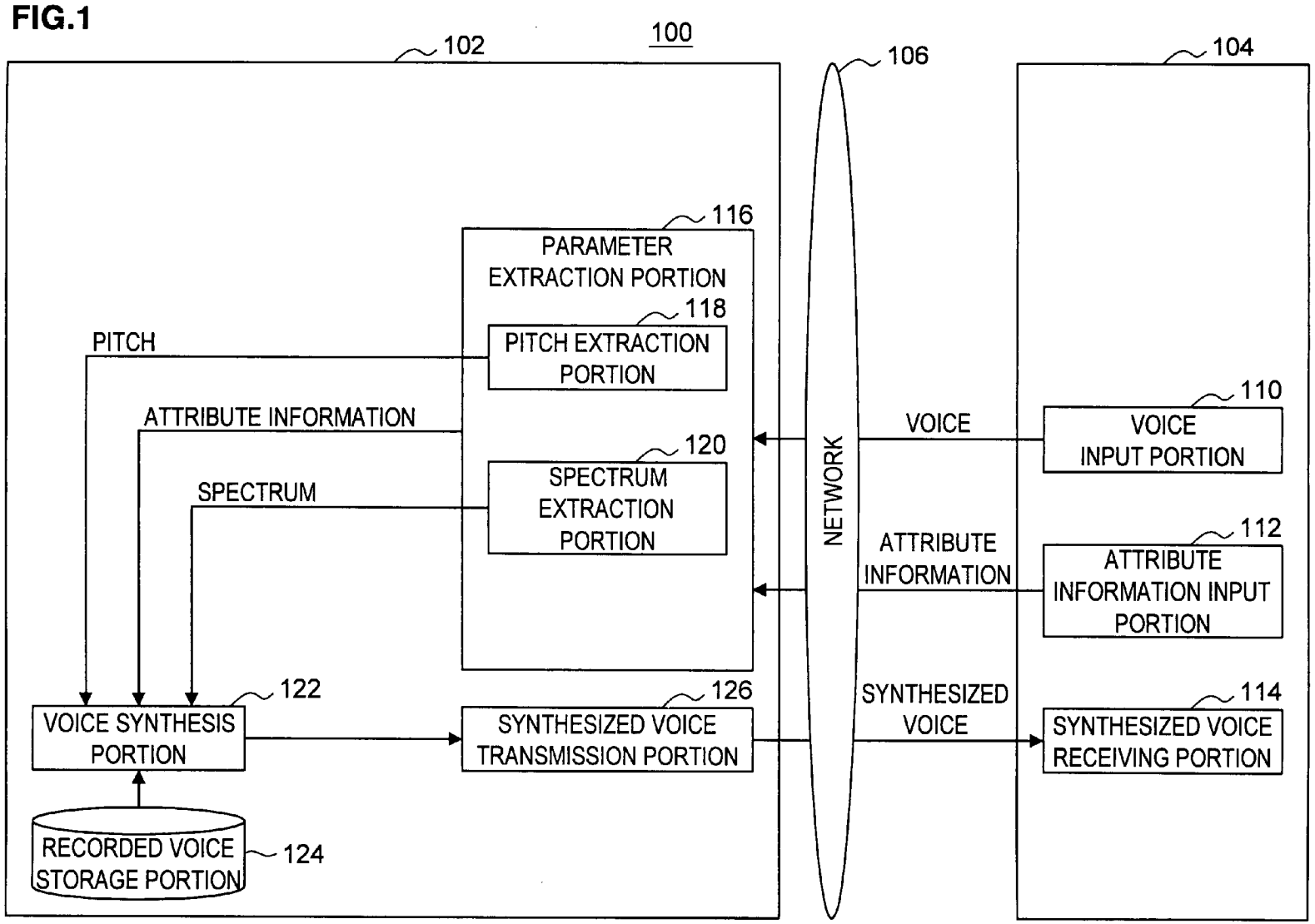
FIG. 1 is a block diagram showing a voice synthesis system according to a first embodiment of the present invention.

Hereinafter, preferred embodiments of the present invention will be described in detail with reference to the appended drawings. Note that, in this specification and the appended drawings, structural elements that have substantially the same function and structure are denoted with the same reference numerals, and repeated explanation of these structural elements is omitted.

First Embodiment

A first embodiment describes an example in which a voice synthesizer according to the present invention is applied as a voice synthesis system 100 including a sever device 102 and a client device 104 that are connected via a network 106. In the voice synthesis system 100, a natural voice is input that reads out a text that is to be generated by synthesized voice. Then, a synthesized voice that has an intonation, accent, and the like, that are the same as or similar to that of the input natural voice is generated and output. Accordingly, a user can read out a text that is to be generated by synthesized voice with a desired intonation, accent, and the like, and input his/her natural voice when reading out the text into the voice synthesis system 100. Thus, a synthesized voice with a desired intonation, accent, and the like can be used to read out the text.

More specifically, for example, the user may wish to generate a synthesized voice that reads a text saying "konnichiwa" (a word which means "hello" in Japanese) in the regional accent of the Kyoto area in Japan. In this case, the user himself/herself reads out the word "konnichiwa" in the Kyoto accent, and inputs his/her natural voice in to the voice synthesis system 100. Alternatively, the natural voice of another person reading out the word "konnichiwa" in a Kyoto accent may be recorded, or the like, and this recorded natural voice may be input in to the voice synthesis system 100. Thus, with the voice synthesis system 100, the user simply has to input a natural voice actually reading out a text with the desired intonation, accent, and the like, in the above described manner, in order to generate a synthesized voice with the desired intonation, accent and the like. Accordingly, it is possible for a user to specify a desired intonation and the like, in accordance with his/her tastes. Further, specification can be performed simply by a general user.

Note that, in the present embodiment, all of the structural element included in the server device 102 and the client device 104 are included in a single computer. This computer may be a voice synthesizer.

First, the overall structure of the voice synthesis system 100 will be described with reference to FIG. 1. As can be seen from FIG. 1, the voice synthesis system 100 includes the server device 102, the client device 104 and the network 106.

The server device 102 has a generation function that generates a synthesized voice when a request is received from the client device 104. More specifically, the server device 102 receives a natural voice and attribute information for this natural voice from the client device 104 via the network 106. The natural voice reads outs a text that is to be generated by the synthesized voice (hereinafter, this natural voice that reads out the text to be generated by the synthesized voice is also referred to as "the reading voice"). The server device 102 derives characteristic parameters indicating the characteristics of the received natural voice, and generates the synthesized voice based on the derived characteristic parameters and the attribute information.

The attribute information includes a label string and label information for the text. The label string is a string of labels assigned to each phoneme included in the reading voice and that are placed in a time series. The label information indicates the border position of each phoneme corresponding to each label, and may be, for example, the start time, the end time, the duration, or the like of each phoneme. In the present embodiment, the label information is the duration of each phoneme.

The characteristic parameters include acoustic parameters that indicate the acoustic characteristics of the reading voice, and prosody parameters that indicated the prosody characteristics of the reading voice. Examples of the acoustic characteristics include spectrum, cepstrum, delta cepstrum, delta-delta cepstrum, power, delta power, delta-delta power, and combinations thereof. In the present embodiment, the acoustic characteristics are predominantly spectrum, and the acoustic characteristics have a value that indicates spectrum. Examples of the prosody characteristics include fundamental frequency (voice pitch), power of the vowel center (voice strength), the phoneme duration (voice length), and the like. In the present embodiment, the prosody characteristics are predominantly fundamental frequency (hereinafter also referred to as "pitch"), and phoneme duration. Note that, the prosody characteristics have a value that indicates pitch, and the phoneme duration is used for the label information.

This completes the explanation of the overall structure of the voice synthesis system 100. Next, the function and structure of the server device 102 and the client device 104 included in the voice synthesis system 100 will be described while referring to FIG. 1.

The client device 104 is a computer that mainly includes an input function, a transmission function, and an output function. The input function is input with a reading voice and the attribute information of the reading voice. The transmission function transmits the input reading voice and the attribute information to the server device 102 via the network 106, and the output function outputs a synthesized voice received from the server device 102. The client device 104 may be, for example, a personal computer, a portable terminal like a mobile phone or a personal digital assistant (PDA), a television, a game machine or the like.

The client device 104, as shown in FIG. 1, mainly includes a voice input portion 110, an attribute information input portion 112, and a synthesized voice receiving portion 114. The voice input portion 110 has an input function that is input with a natural voice that reads out a text that is to be generated by a synthesized voice. The voice input portion 110 may include a microphone so that the reading voice of, for example, the user reading out the text himself/herself can be input to the voice input portion 110. In addition, the voice input portion 110 may be able to read a reading voice from various types of storage medium so that a reading voice pre-recorded on a storage medium like a compact disk, a flexible disk, a USB memory device or the like can be input to the voice input portion 110. The voice input storage portion 110 transmits the input reading voice to the server device 102 via the network 106.

The attribute information input portion 112 has an input function that is input with a label string and label information. More specifically, the attribute information input portion 112 is input with a label string and label information that is generated in advance by the user. The user generates the label string and the label information based on the reading voice input in to the voice input portion 110, and inputs them in to the attribute information input portion 112. FIG. 2 will be used to explain the label string and the label information.

FIG. 2 shows the label string and the label information in the case that the voice input to the voice input portion 110 is a reading voice that reads out a text that says "mukashi" (a word which means "long ago" in Japanese). A label string 1120 includes labels for each of the phonemes included in the text "mukashi". The labels for each phoneme have been placed in a time series. Label information 1122 indicates the duration of each phoneme. In FIG. 2, the units of the numerical values for each piece of label information are milliseconds. As can be seen from FIG. 2, the voice input to the voice input portion 110 is a reading voice that reads out the text saying "mukashi". Among the phonemes that form "mukashi", the "M" sound has a 200 millisecond duration, the "U" sound has a 150 millisecond duration, the "K" sound has a 25 millisecond duration, the "A" sound has a 300 millisecond duration, the "SH" sound has a 110 millisecond duration, and the "I" sound has a 130 millisecond duration.

Next, the explanation of the functions and structure of the client device 104 will be continued while referring again to FIG. 1. The attribute information input portion 112 transmits the input label string and the label information to the server device 102 via the network 106.

The synthesized voice receiving portion 114 receives the synthesized voice generated by the server device 102 from the server device 102 via the network 106. In addition, the synthesized voice receiving portion 114 may output the received synthesized voice using a speaker provided in the client device 104. This completes the description of the functions and structure of the client device 104.

Next, the functions and structure of the server device 102 will be explained. The server device 102 is a computer that receives the reading voice, the label string and the label information from the client device 104 via the network 106. Then, the server device 102 uses the received reading voice, the label string and the label information as a basis for deriving the characteristic parameters of the reading voice, and synthesizes the voice in accordance with the derived parameters. The server device 102 then transmits the generated synthesized voice to the client device 104 via the network 106.

Referring to FIG. 1, the server device 102 mainly includes a parameter extraction portion 116, a voice synthesis portion 122, a recorded voice storage portion 124, and a synthesized voice transmission portion 126. The parameter extraction portion 116 has a derivation function that derives the characteristic parameters of the reading voice using the input reading voice, the label string and the label information received from the client device 104. More specifically, the parameter extraction portion 116 includes a pitch extraction portion 118 and a spectrum extraction portion 120. The pitch extraction portion 118 extracts the pitch that is one of the prosody characteristics of the reading voice. The spectrum extraction portion 120 extracts the spectrum that is one of the acoustic characteristics of the reading voice. The pitch extraction and the spectrum extraction of the voice may be performed using a known method. The parameter extraction portion 116 outputs the pitch extracted by the pitch extraction portion 118, the spectrum extracted by the spectrum extraction portion 120, and the label string and the label information input to the parameter extraction portion 116 to the voice synthesis portion 122.

The voice synthesis portion 122 has a generation function that is input with the pitch, the spectrum, the label string and the label information of the reading voice input from the parameter extraction portion 116. The generation function then generates the synthesized voice based on the various types of input information. More specifically, the voice synthesis portion 122 uses each phoneme indicated by the label string as a basis for obtaining corresponding voices from the recorded voice storage portion 124. The obtained voices are arranged and joined in accordance with the time series indicated by the label string, thereby generating the synthesized voice. Note that, when the voice synthesis portion 122 obtains each voice from the recorded voice storage portion 124 the voice that has the closest pitch, spectrum, and duration is selected and obtained based on the input pitch, spectrum and label information. Accordingly, the synthesized voice generated by the voice synthesis portion 122 has a pitch and spectrum that is similar to the pitch and spectrum of the reading voice. Further, the duration time of each phoneme that forms the synthesized voice is a duration that is similar to that of each phoneme that forms the reading voice. The pitch indicates the pitch of the voice, and changes in the pitch indicate the intonation of the voice. Thus, if the duration time of each phoneme and the pitch are similar, the intonation and the accent will be substantially similar. In this manner, the voice synthesis portion 122 uses the input pitch, the spectrum, the label string, and the label information as a basis for generating a synthesized voice that has an intonation and accent that are similar to the reading voice. The voice synthesis portion 122 outputs the generated synthesized voice to the synthesized voice transmission portion 126.

The synthesized voice transmission portion 126 transmits the synthesized voice input from the voice synthesis portion 122 to the client device 104 via the network 106.

The recorded voice storage portion 124 stores recorded voices that are voices that have been pre-recorded. The recorded voices are recordings of natural voices reading out various different texts, sentences, and the like, and form a recorded voice corpus of natural voices that can be split into phoneme units or divided-phoneme units. Hereinafter, the people whose spoken voices are stored in the recorded voice storage portion 124 will also be referred to as the "speaker". The recorded voice storage portion 124 may store the voice of one speaker, or may store the voices of a plurality of different speakers. In addition, the user who reading voice is input in to the voice input portion 110 of the client device 104 and the speaker may be the same person, or may be different people. Next, the function and structure of the server device 102 will be explained.

Figure 3:
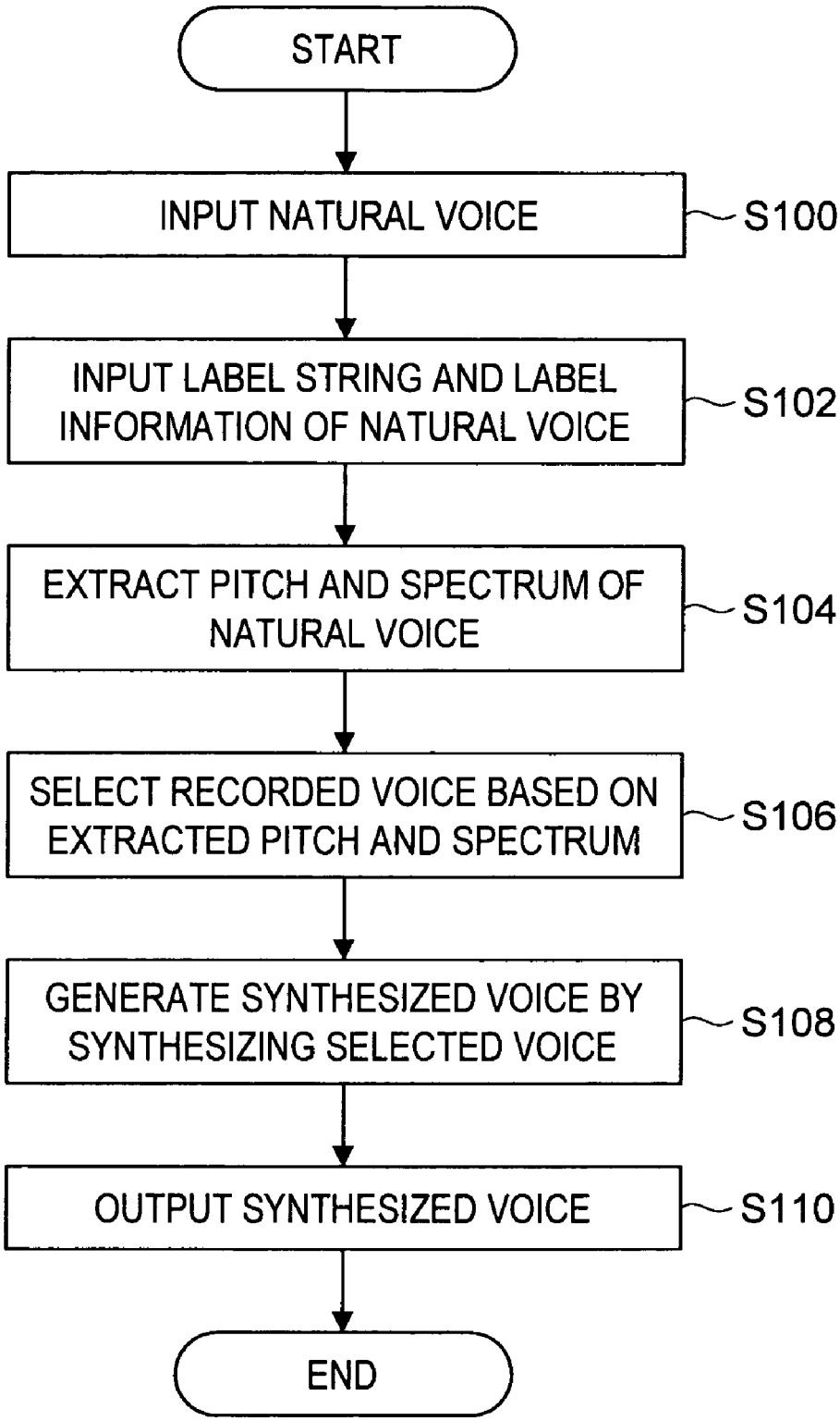
FIG. 3 is a flow chart showing voice synthesis processing according to the first embodiment.

Next, the flow of voice synthesis processing of the voice synthesis system 100 will be explained with reference to FIG. 3. Referring to FIG. 3, first, the natural voice is input to the voice synthesis system 100 (step S100). More particularly, the natural voice of the user reading out a desired text is input. Next, the label string and the label information of the natural voice input in step S100 is input to the voice synthesis system 100 (step S102). After receiving this input, the voice synthesis system 100 extracts the pitch and the spectrum of the input natural voice (step S104). Next, the voice synthesis system 100 selects recorded voices based on the extracted pitch and spectrum, and the label string and the label information input in step S102 (step S106). The voice synthesis system 100 joins and synthesizes the voices selected in S106 (step S108), and then outputs the generated synthesized voice (step S100).

Hereinabove, the voice synthesis system 100 according to the first embodiment has been explained. As a result of adopting the structure of the client device 104 and the server device 102 described in the first embodiment, the user is able to input a reading voice to the client device 104 that reads out a desired text with a desired intonation and accent. Accordingly, the server device 102 can generate a synthesized voice having a similar intonation and accent to the reading voice, and the client device 104 can output this synthesized voice. Thus, the user can specify the intonation and accent he/she wants the synthesized voice to have as a result of performing the reading himself/herself. Accordingly, since it is easy to specify a desired intonation and accent, the user can specify a synthesized voice that satisfies his/her tastes.

Second Embodiment

A second embodiment describes an example in which a voice synthesizer according to the present invention is applied as a voice synthesis system 200 including a sever device 202 and a client device 204 that are connected via the network 106. In the voice synthesis system 200, as in the voice synthesis system 100 according to the first embodiment, a natural voice is input that reads out a text that is to be generated by synthesized voice. Then, a synthesized voice that has an intonation and accent that is the same as or similar to that of the input natural voice is generated and output. In the first embodiment, the pitch and spectrum are both extracted from the input reading voice. However, the present embodiment differs from the first embodiment with respect to the fact that only the pitch is extracted, and the spectrum is estimated. This estimation is based on the extracted pitch, the input label string and the label information, and language prosody information and a phoneme model that are described later. The following description will focus on points of difference of the second embodiment from the first embodiment.

First, the overall structure of the voice synthesis system 200 will be described with reference to FIG. 4. As can be seen from FIG. 4, the voice synthesis system 200 includes the server device 202, the client device 204 and the network 106.

The server device 202 has a generation function that generates a synthesized voice when a request is received from the client device 204. More specifically, the server device 202 receives the reading voice, the attribute information for this reading voice, and the read out text that is read out by the reading voice from the client device 204 via the network 106. The server device 202 analyses the part of speech units of the received text, and generates language prosody information that is assigned with corresponding parts of speech and accents for each part of speech of the text. In addition, the server device 202 extracts the pitch, which is a characteristic parameter indicating the prosody characteristics of the received natural voice. Further, the server device 202 derives a corresponding spectrum based on the generated language prosody information, the extracted pitch, the label string and the label information received from the client device 204, while also referring to the phoneme model. Then, the server device 202 generates the synthesized voice based on the pitch extracted from the reading voice, the spectrum derived as described above, and the label string and the label information received from the client device 204.

Note that, in the present embodiment, all of the structural elements included in the server device 202 and the client device 204 are included in a single computer. This computer may be a voice synthesizer.

This completes the explanation of the overall structure of the voice synthesis system 200. Next, the function and structure of the client device 204 and server device 202 will be described while referring to FIG. 4. Note that, structural elements that have the same function as those described in the first embodiment are denoted with the same reference numerals, and a detailed explanation thereof is omitted.

The client device 204 is a computer that mainly includes an input function, a transmission function, and an output function. The input function is input with a reading voice, attribute information of the reading voice, and the read out text. The transmission function transmits the input reading voice, the attribute information, and the text to the server device 202 via the network 106. The output function outputs a synthesized voice received from the server device 202.

Figure 4:
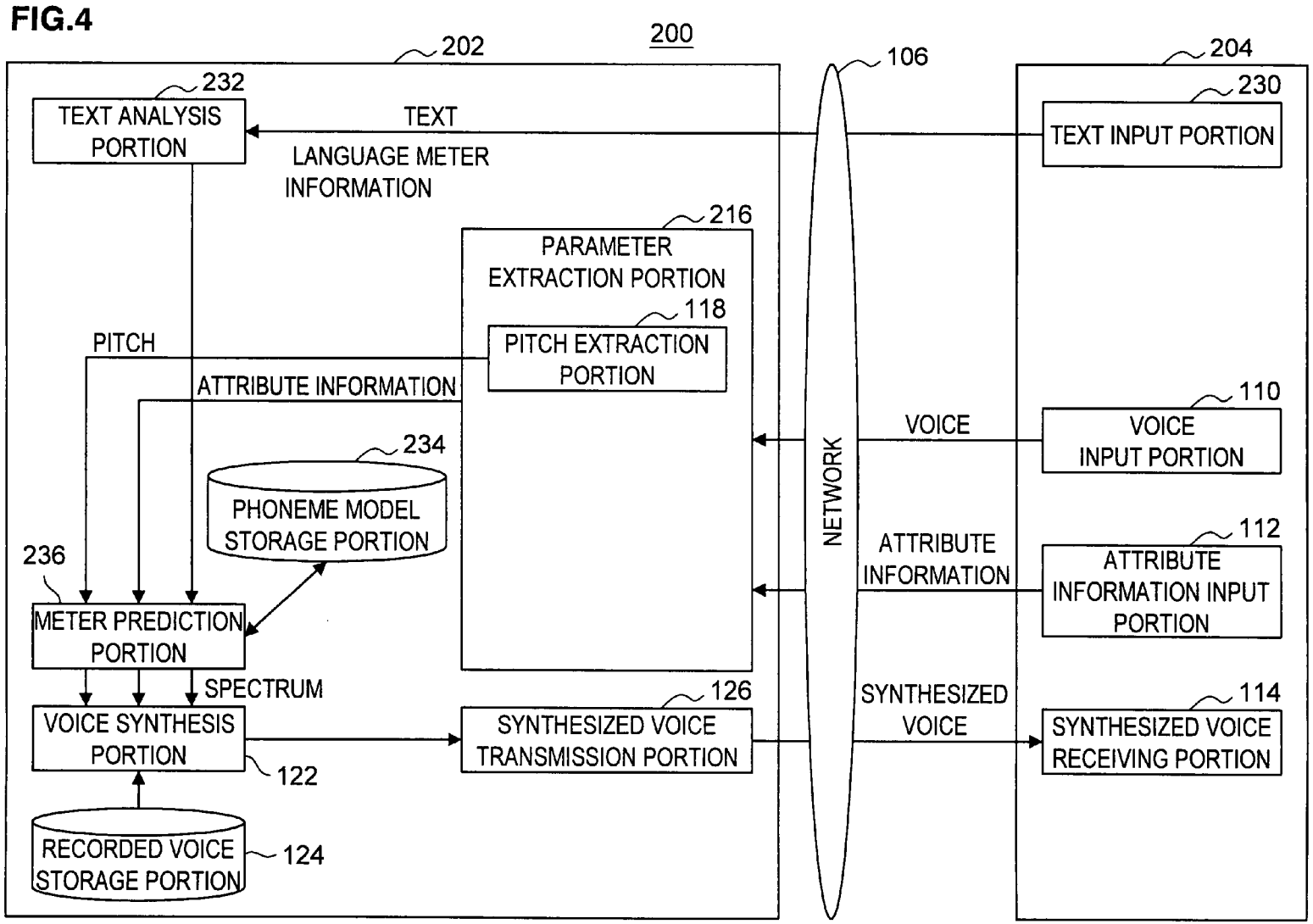
FIG. 4 is a block diagram showing a voice synthesis system according to a second embodiment of the present invention.

The client device 204, as shown in FIG. 4, mainly includes a text input portion 230, the voice input portion 110, the attribute information input portion 112, and the synthesized voice receiving portion 114.

The text input portion 230 is input with the text that is the read out by the reading voice input to the voice input portion 110. More specifically, the text input portion 230 includes an input device such as a keyboard or the like that the user uses to input the text. The input text is transmitted to the server device 202 via the network 106.

The server device 202 is a computer that receives the reading voice, the text, the label string and the label information from the client device 204 via the network 106. Then, the server device 202 uses the received reading voice, and the label string and the label information as a basis for deriving characteristic parameters that indicate the prosody characteristics of the reading voice. Next, the server device 202 derives parameters indicating the acoustic characteristics that the synthesized voice needs to have based on the derived parameters, analysis results for the text, and the phoneme model. The server device 202 then synthesizes the voice in accordance with each parameter, and transmits the generated synthesized voice to the client device 204 via the network 106.

Referring to FIG. 4, the server device 202 mainly includes a text analysis portion 232, a parameter extraction portion 216, a phoneme model storage portion 234, a prosody prediction portion 236, the voice synthesis portion 122, the recorded voice storage portion 124, and the synthesized voice transmission portion 126. The parameter extraction portion 216 has a derivation function that derives the characteristic parameters of the reading voice using the input reading voice, the label string and the label information received from the client device 204. More specifically, the parameter extraction portion 216 includes the pitch extraction portion 118 that extracts the pitch of the reading voice.

The text analysis portion 232 has a generation function that performs morphological analysis and modification analysis on the text received from the client device 204, and analyses the part of speech units. Then, the generation function then generates the language prosody information that is assigned with corresponding parts of speech and accents for each part of speech of the text. The analysis of the text may be performed using a known method.

The prosody prediction portion 236 has a derivation function that derives the spectrum that the synthesized voice needs to have based on the pitch, the label string and the label information (which are indicated together in FIG. 2 as the attribute information), and the language prosody information while referring to the phoneme model stored in the phoneme model storage portion 234. The phoneme model storage portion 234 stores an acoustic model and a prosody model that are generated in advance based on the recorded voices stored in the recorded voice storage portion 124. The acoustic model models the acoustic characteristics of each phoneme included in the recorded voice, and the prosody model models the prosody characteristics of each phoneme included in the recorded voice. The acoustic model and the prosody model form, as a pair, the phoneme model. Next, FIG. 5 will be used to explain about the recorded voice storage portion 124.

Figure 5:
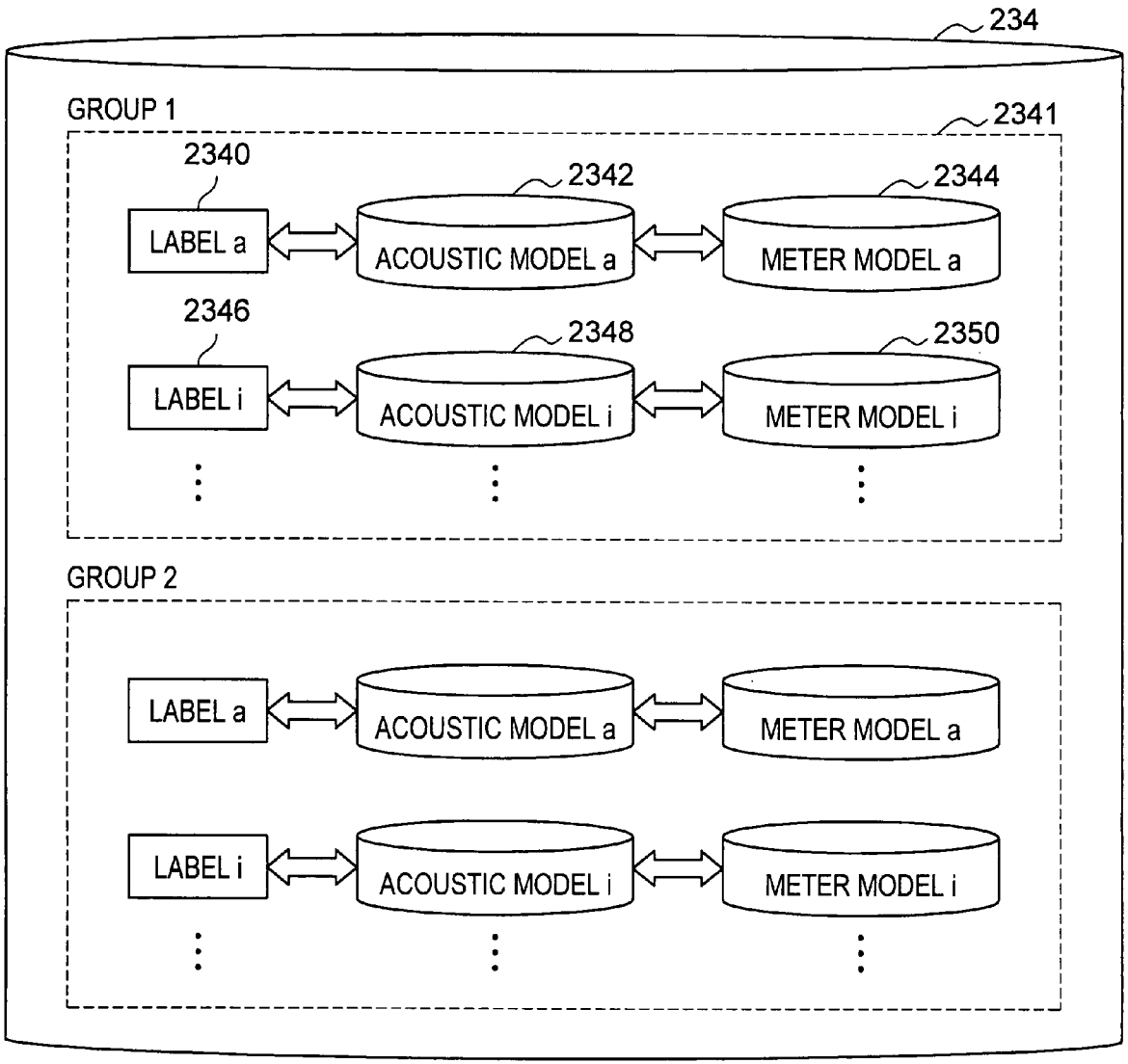
FIG. 5 is an explanatory diagram showing a phoneme model storage portion according to the second embodiment.

Referring to FIG. 5, the acoustic model and the prosody model are stored as a pair for each label in the phoneme model storage portion 234. More specifically, an acoustic model a 2342 models the acoustic characteristics of the speaker related to label a 2340, and a prosody model a 2344 models the prosody characteristics of the speaker related to label a 2340. The acoustic model a 2342 and the prosody model a 2344 are linked. Similarly, an acoustic model i 2348 models the acoustic characteristics of the speaker related to label i 2346, and a prosody model i 2350 models the prosody characteristics of the speaker related to label i 2346. The acoustic model i 2348 and the prosody model i 2350 are linked. In this manner, the phoneme model storage portion 234 stores paired acoustic models and prosody models for each label. Note that, the acoustic models and the prosody models may be a hidden Markov model (HMM).

The paired acoustic models and prosody models may be separated in to groups as shown in FIG. 5. In the case that the recorded voice storage portion 124 stores the voices of a plurality of different speakers, for example, the models may be separated in to groups for each different speaker, or in to groups based on different speaking tones. If groups of different speaking tones are used, voices that speak in a normal conversation tone and voices that speak with a reading voice tone that is like that of a news reader may be placed in different groups and respectively modeled. More specifically, for example, group 1 in FIG. 5 (indicated by the reference numeral 2341) may have an acoustic model and a prosody model that model the voices, among those stored in the recorded voice storage portion 124, that speak with a normal conversation tone, and group 2 may have an acoustic model and a prosody model that model the voices that speak with a reading voice tone.

Next, returning to FIG. 4, the functions and structure of the server device 202 will be explained. The prosody prediction portion 236 derives an appropriate spectrum based on the language prosody information generated by the text analysis portion 232, the pitch extracted by the pitch extraction portion 118, and the label string and the label information received from the client device 204 while referring to the acoustic models and prosody models stored in the phoneme model storage portion 234. More specifically, the prosody prediction portion 236 obtains the acoustic models linked with each label included in the label string from the phoneme model storage portion 234, arranges the obtained acoustic models, and derives a spectrum in accordance with the frame shift length and the label information. Then, the prosody prediction portion 236 outputs the derived spectrum to the voice synthesis portion 122.

The voice synthesis portion 122 generates the synthesized voice based on the pitch extracted by the pitch extraction portion 118, the label string and the label information received from the client device 104 and the spectrum derived by the prosody prediction portion 236. This completes the description of the functions and structure of the server device 202.

Figure 6:
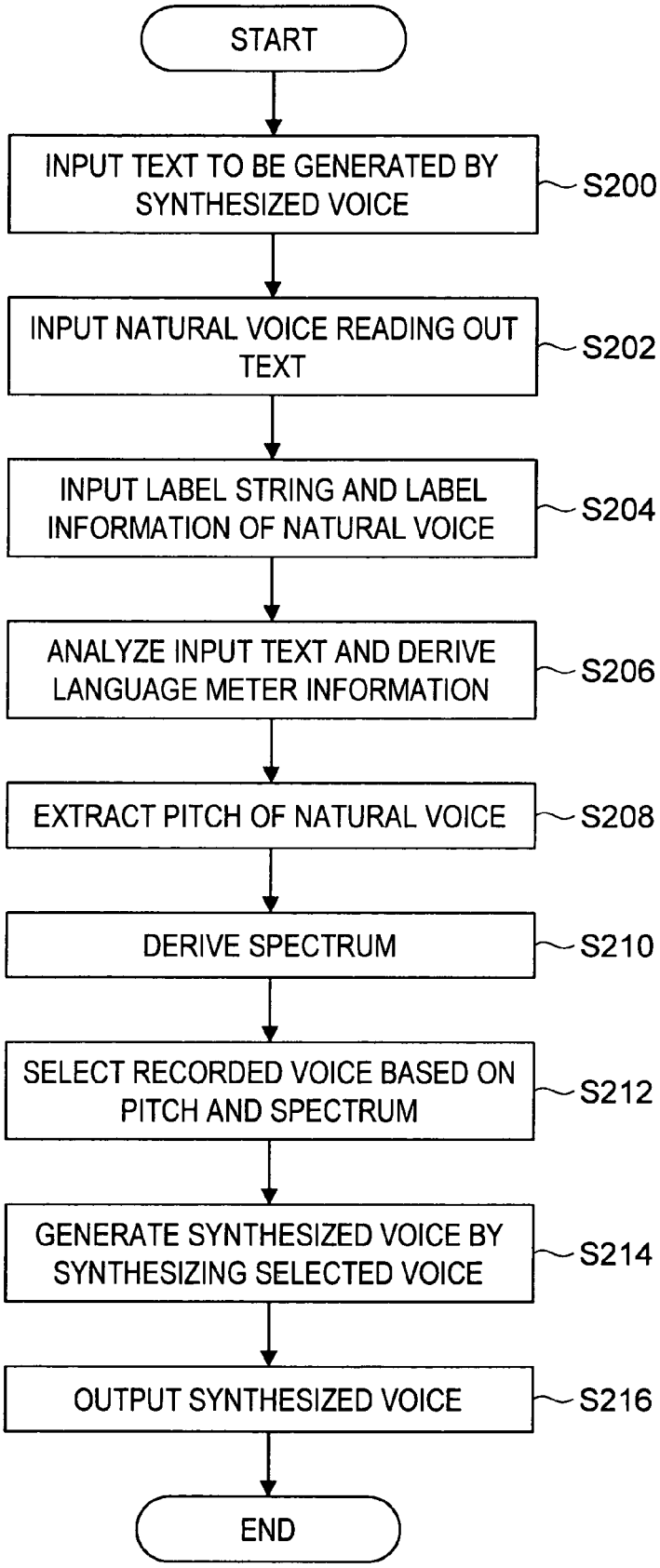
FIG. 6 is a flow chart showing voice synthesis processing according to the second embodiment.

Next, the flow of voice synthesis processing of the voice synthesis system 200 will be explained with reference to FIG. 6. First, the text that is to be generated by synthesized voice is input to the voice synthesis system 200 (step S200). Then, a natural voice reading out the text is input to the voice synthesis system 200 (step S202). Next, the label string and the label information of the natural voice input in step S202 is input to the voice synthesis system 200 (step S204). Note that, the order of steps S200 and S202 may be reversed.

Next, the voice synthesis system 200 analyses the text input in step S200, and generates the language prosody information (step S206). The voice synthesis system 200 then extracts the pitch of the reading voice input in step S202 (step S208), and derives the spectrum (step S210). Next, the voice synthesis system 200 selects recorded voices based on the pitch extracted in step S208, the spectrum derived in step S210, and the label string and the label information input in step S204 (step S212). Following this, the voice synthesis system 200 synthesizes the selected voices to generate the synthesized voice (step S214), and then outputs the generated synthesized voice (step S216).

Figure 7:
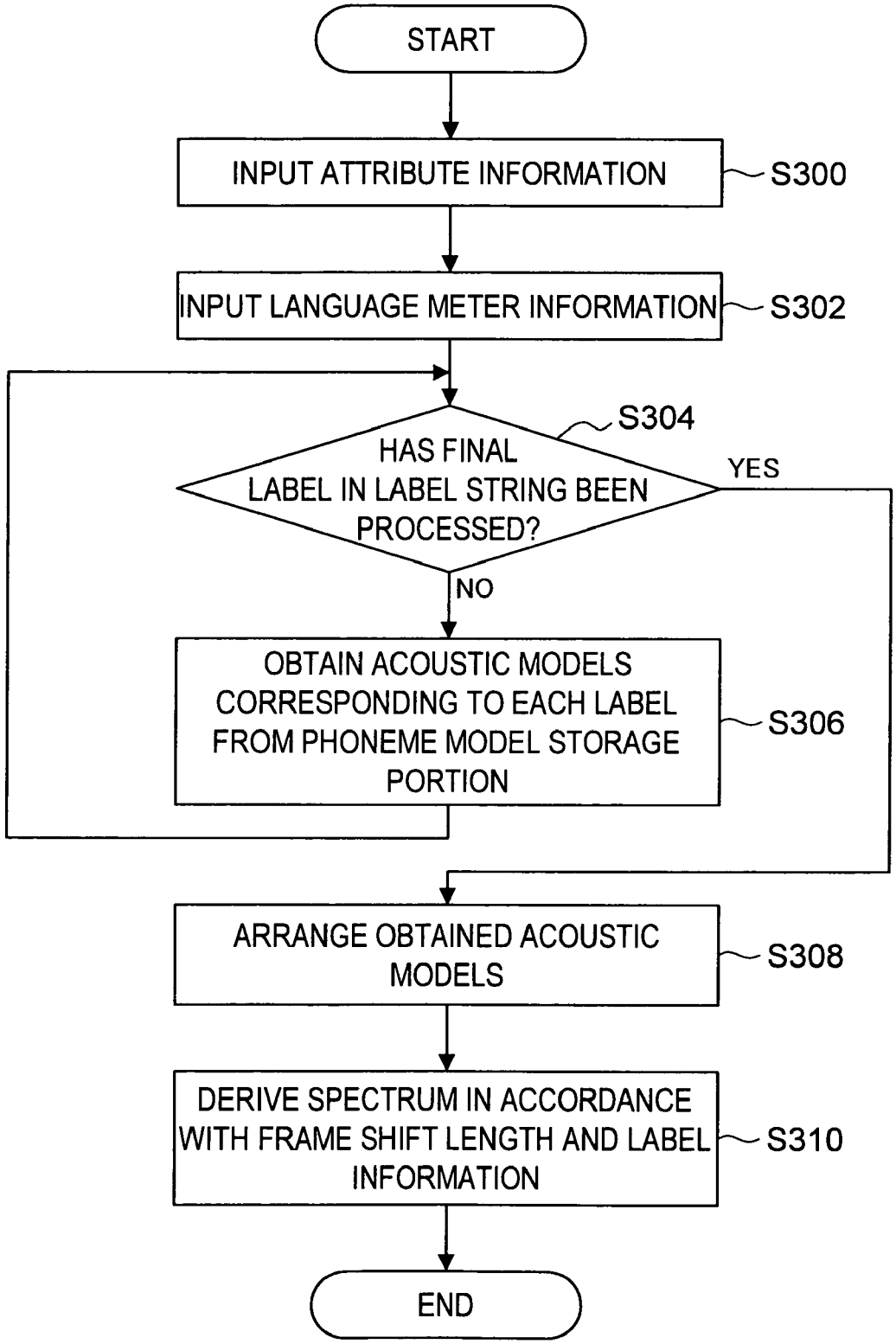
FIG. 7 is a flow chart showing a section of the voice synthesis processing according to the second embodiment.

Next, a spectrum derivation process of step S210 of FIG. 6 for deriving the spectrum will be explained with reference to FIG. 7. FIG. 7 shows the flow of the spectrum derivation process that is performed by the prosody prediction portion 236 in the voice synthesis system 200. As can be seen from FIG. 7, the prosody prediction portion 236 is input with the attribute information (the label string and the label information) (step S300), and input with the language prosody information (step S302). Then, sound models are obtained from the phoneme model storage portion 234 that correspond to each label (step S306) for all the labels up to the final one in the label string (step S304). After the processing of step S306 has been performed for all the labels included in the label string, the prosody prediction portion 236 arranges the obtained acoustic models (step S308). The, the spectrum is derived in accordance with the frame shift length and the label information (step S310). The frame shift length is the time interval at which the spectrum is derived, which in this case is the same time interval as the time interval at which the parameter extraction portion 118 extracts the pitch from the reading voice. More particularly, in the case that the pitch is extracted every 5 milliseconds from after the reading voice starts, for example, the frame shift length is 5 millimeters, and the spectrum is derived at this time interval.

Hereinabove, the voice synthesis system 200 according to the second embodiment has been explained. As a result of adopting the structure of the client device 204 and the server device 202 described in the second embodiment, the user is able to input a reading voice to the client device 204 that reads out a desired text with a desired intonation and accent. Accordingly, the server device 202 can generate a synthesized voice having a similar intonation and accent to the reading voice, and the client device 204 can output this synthesized voice. Thus, the user can specify the intonation and accent he/she wants the synthesized voice to have as a result of performing the reading himself/herself. Accordingly, since it is easy to specify a desired intonation and accent, the user can specify a synthesized voice that satisfies his/her tastes. Moreover, according to the second embodiment, the server device 202 derives an appropriate spectrum based on the pitch extracted from the input reading voice, the input label information and the like, and the phoneme model that is modeled from voice data stored in the recorded voice storage portion 124. Accordingly, even if the user whose spoken voice is used for the reading voice, and the speaker who spoken voice is recorded in the recorded voice storage portion 124 are different, deterioration in sound quality can be inhibited and subtle prosody changes can be performed.

Third Embodiment

A third embodiment describes an example in which a voice synthesizer according to the present invention is applied as a voice synthesis system 300 including a sever device 302 and a client device 304 that are connected via the network 106. In the voice synthesis system 300, as in the voice synthesis system 100 according to the first embodiment, a natural voice is input that reads out a text which is to be generated by synthesized voice. Then, a synthesized voice that has an intonation and accent that is the same as or similar to that of the input natural voice is generated and output. In the first embodiment, the pitch and spectrum are both extracted from the input reading voice. However, the present embodiment differs from the first embodiment with respect to the fact that only the pitch is extracted, and the spectrum is estimated. This estimation is based on the extracted pitch, the label string and the label information, and the language prosody information and a phoneme model. In addition, although the present embodiment is the same as the second embodiment in that the spectrum is estimated as described above, the present embodiment differs from the second embodiment with respect to the fact that the label string and the label information are generated by the server device 202. In the second embodiment, on the other hand, the label string and the label information are input from the client device 204. The following description will focus on points of difference of the third embodiment from the first embodiment and the second embodiment.

First, the overall structure of the voice synthesis system 300 will be described with reference to FIG. 8. As can be seen from FIG. 8, the voice synthesis system 300 includes the server device 302, the client device 304 and the network 106.

The server device 302 has a generation function that generates a synthesized voice when a request is received from the client device 304. More specifically, the server device 302 receives the reading voice and the read out text from the client device 304 via the network 106. The server device 302 analyses the part of speech units of the received text, and generates the language prosody information and the label string. In addition, the server device 302 extracts the pitch, which is a characteristic parameter indicating the prosody characteristics of the received natural voice. Further, the server device 302 generates label information for the reading voice based on the label string obtained from the text analysis, the input reading voice, and an individual label acoustic model, which is stored in an individual label acoustic model storage portion 342, described later. Then, the server device 302 derives a corresponding spectrum based on the generated language prosody information, the generated label string and label information, and the extracted pitch, while also referring to the phoneme model. Finally, the server device 302 generates the synthesized voice based on the pitch extracted from the reading voice, the spectrum derived as described above, and the label string and the label information generated by the server device 302.

Note that, in the present embodiment, all of the structural elements included in the server device 302 and the client device 304 are included in a single computer. This computer may be a voice synthesizer.

This completes the explanation of the overall structure of the voice synthesis system 300. Next, the functions and structure of the client device 304 and server device 302 will be described while referring to FIG. 8. Note that, structural elements that have the same function as those described in the first embodiment and the second embodiment are denoted with the same reference numerals, and a detailed explanation thereof is omitted.

The client device 304 is a computer that mainly includes an input function, a transmission function, and an output function. The input function is input with a reading voice and the read out text. The transmission function transmits the input reading voice and the text to the server device 302 via the network 106. The output function outputs a synthesized voice received from the server device 302.

Figure 8:
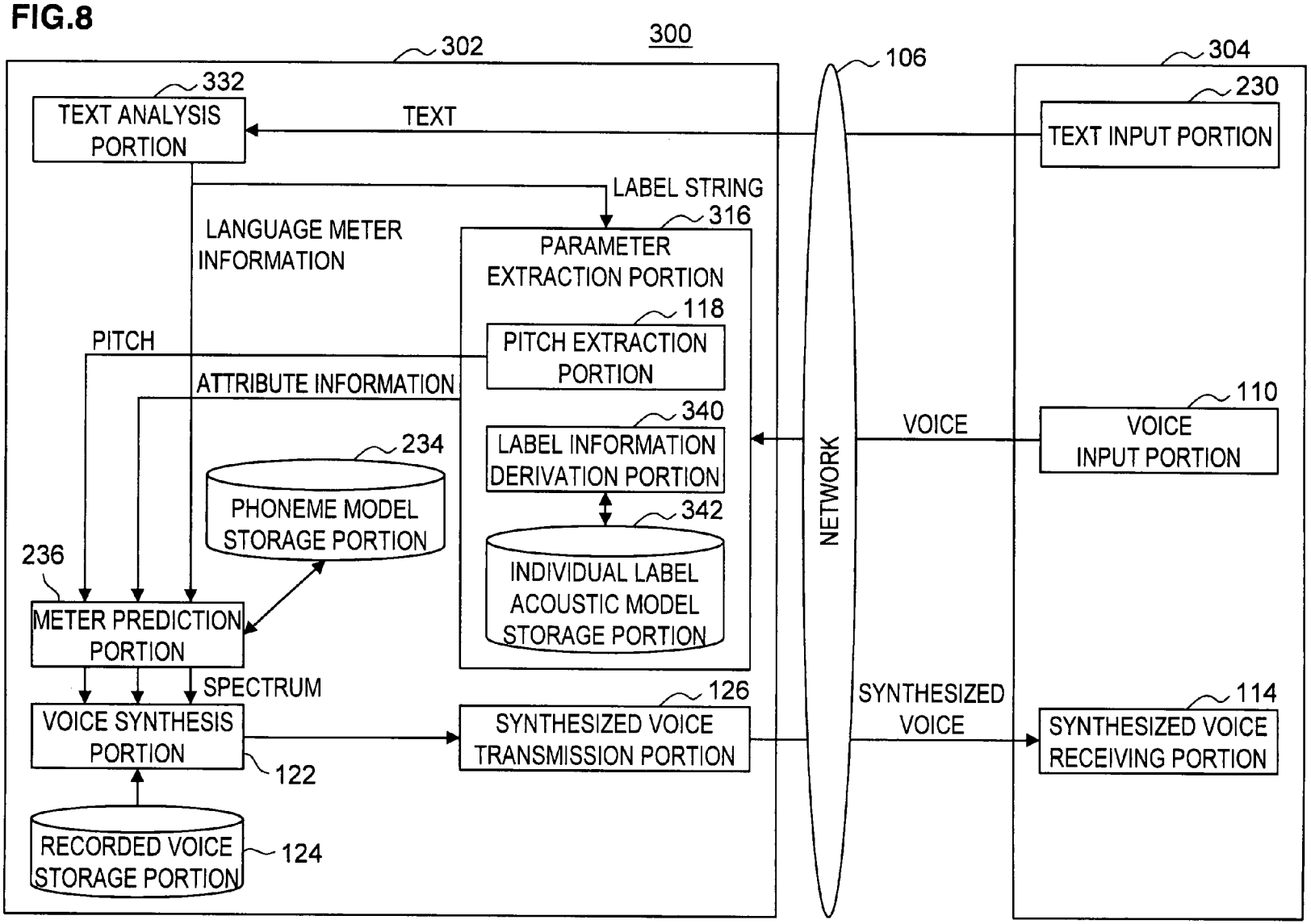
FIG. 8 is a block diagram showing a voice synthesis system according to a third embodiment of the present invention.

The client device 304, as shown in FIG. 8, mainly includes the text input portion 230, the voice input portion 110, and the synthesized voice receiving portion 114. The client device 304 does not include the attribute information input portion 112 that is provided in the client device 104 of the first embodiment and the client device 204 of the second embodiment. Accordingly, it is sufficient if the user inputs the text and the natural voice that reads out the text to the client device 304.

The server device 302 receives the reading voice and the text from the client device 304 via the network 106. Then, the server device 302 analyses the text to generate the label string, and then generates label information for the reading voice using the label string and the reading voice. Then, the server device 302 uses the received reading voice, and the generated label string and the label information as a basis for deriving characteristic parameters that indicate the prosody characteristics of the reading voice. Next, the server device 302 derives parameters indicating the acoustic characteristics that the synthesized voice needs to have based on the derived parameters, analysis results for the text, and the phoneme model. The server device 302 then synthesizes the voice in accordance with each parameter, and transmits the generated synthesized voice to the client device 304 via the network 106.

Referring to FIG. 8, the server device 302 mainly includes a text analysis portion 332, a parameter extraction portion 316, the phoneme model storage portion 234, the prosody prediction portion 236, the voice synthesis portion 122, the recorded voice storage portion 124, and the synthesized voice transmission portion 126. The text analysis portion 332 has a generation function that analyses the text received from the client device 304, and generates the language prosody information and the label string. The text analysis portion 332 outputs the generated label string to the parameter extraction portion 316.

The parameter extraction portion 316 includes the pitch extraction portion 118 that extracts the pitch of the reading voice, and a label information derivation portion 340 that derives the label information of the reading voice. The label information derivation portion 340 has a derivation function that derives the label information of the reading voice based on the reading voice received from the client device 204, and the label string input from the text analysis portion 332. More specifically, the label information derivation portion 340 extracts the spectrum of the reading voice and then derives the label information based on the extracted spectrum while using acoustic models, stored in the individual label acoustic model storage portion 342, that correspond to each phoneme that forms the reading voice. The individual label acoustic model storage portion 342 will be described with reference to FIG. 9.

Figure 9:
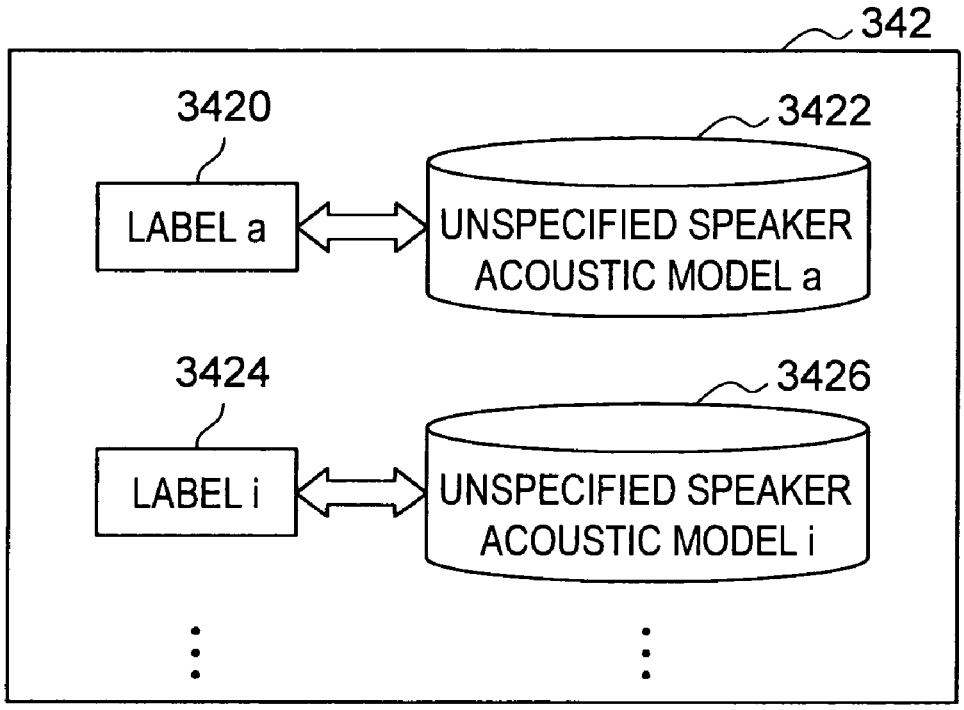
FIG. 9 is an explanatory diagram showing an individual label acoustic model storage portion according to the third embodiment.

Referring to FIG. 9, acoustic models for unspecified speakers are stored in the individual label acoustic model storage portion 342 for each label. More particularly, the acoustic models for the non-specified speakers statistically model the acoustic characteristics of phonemes corresponding to each label based on the voice or voices of a single or a plurality of different unspecified speakers. As can be seen in FIG. 9, an unspecified speaker acoustic model a 3422 corresponds to label a 3420, and an unspecified speaker acoustic model i 3426 corresponds to a label i 3424.

Next, returning to FIG. 8, the functions and structure of the server device 302 will be explained. The label information derivation portion 340 pre-processes a spectrum string, which is a time series of the spectrum (acoustic characteristic) extracted from the reading voice, and the label string. The label information derivation portion 340 derives the label information of the reading voice by determining temporal correspondence of the label and spectrum strings based on the acoustic similarity of the label and spectrum strings, in accordance with the acoustic models stored in the individual label acoustic model storage portion 342.

The prosody prediction portion 236 derives an appropriate spectrum based on the language prosody information generated by the text analysis portion 332, the pitch extracted by the pitch extraction portion 118, the label information derived by the label information derivation portion 340, and the acoustic models and prosody models stored in the phoneme model storage portion 234. Other features of the server device 302 are the same as those described in the second embodiment, and thus repeated explanation will be omitted here. This completes the explanation of the functions and structure of the server device 302.

Figure 10:
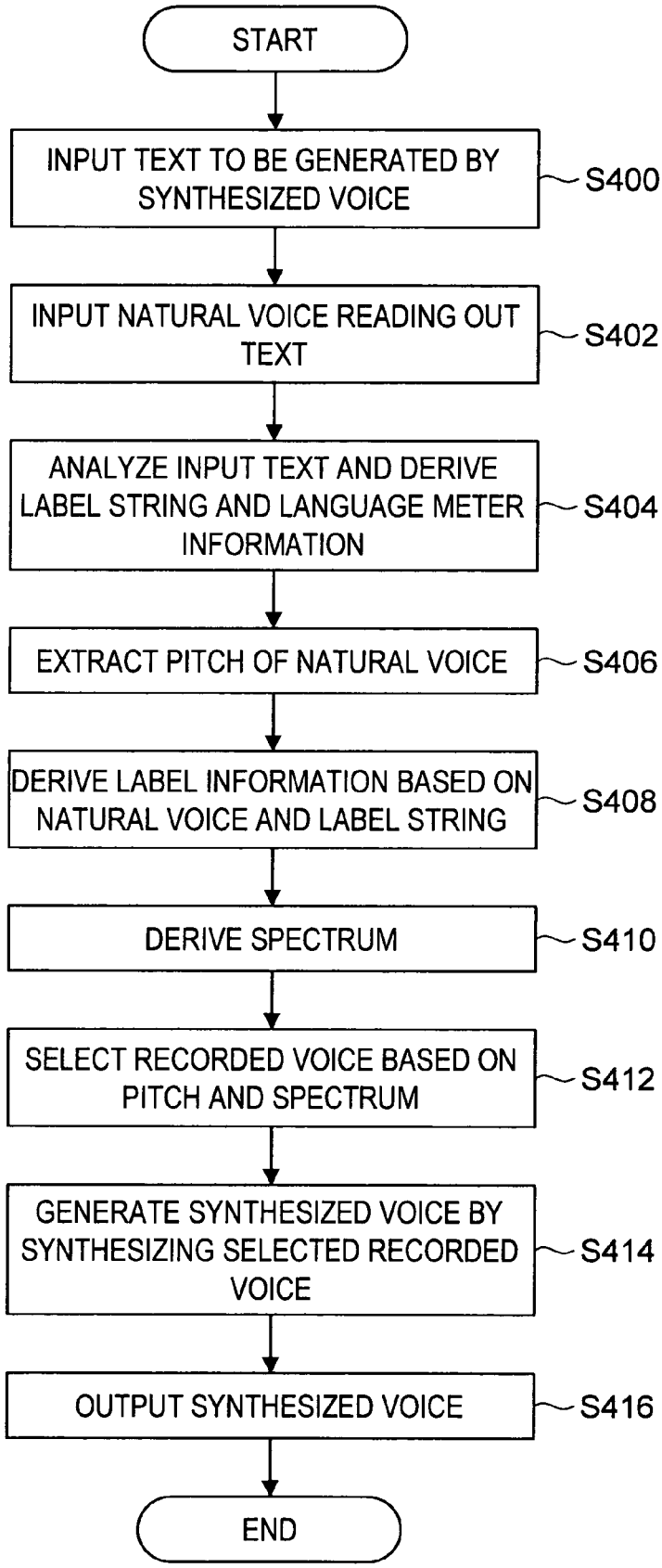
FIG. 10 a flow chart showing voice synthesis processing according to the third embodiment.

Next, the flow of voice synthesis processing of the voice synthesis system 300 will be explained with reference to FIG. 10. First, the text that is to be generated by synthesized voice is input in to the voice synthesis system 300 (step S400). Then, a natural voice reading out the text is input in to the voice synthesis system 300 (step S402).

Next, the voice synthesis system 300 analyses the text input in step S400, and generates the language prosody information and the label string (step S404). The voice synthesis system 300 then extracts the pitch of the reading voice input in step S402 (step S406). Then, the voice synthesis system 300 derives the label information of the reading voice based on the natural voice input in step S402 and the label string generated in step S404 (step S408). The voice synthesis system 300 then derives the spectrum (step S410), and selects recorded voices based on the pitch extracted in step S406, the spectrum derived in step S410, the label string generated in step S404, and the label information derived in step S408 (step S412). Following this, the voice synthesis system 300 synthesizes the selected voices to generate the synthesized voice (step S414), and then outputs the generated synthesized voice (step S416).

Hereinabove, the voice synthesis system 300 according to the third embodiment has been explained. As a result of adopting the structure of the client device 304 and the server device 302 described in the third embodiment, the user is able to input a reading voice to the client device 304 that reads out a desired text with a desired intonation and accent. Accordingly, the server device 302 can generate a synthesized voice having a similar intonation and accent to the reading voice, and the client device 304 can output this synthesized voice. Thus, the user can specify the intonation and accent he/she wants the synthesized voice to have as a result of performing the reading himself/herself. Accordingly, since it is easy to specify a desired intonation and accent, the user can specify a synthesized voice that satisfies his/her tastes. Moreover, according to the third embodiment, as with the second embodiment, the server device 302 derives an appropriate spectrum based on the pitch extracted from the input reading voice, the label information and the like, and the phoneme model that is modeled from voice data stored in the recorded voice storage portion 124. Accordingly, even if the user whose spoken voice is used for the reading voice, and the speaker who spoken voice is recorded in the recorded voice storage portion 124 are different, deterioration in sound quality can be inhibited and subtle prosody changes can be performed. Moreover, in the third embodiment, since the server device 302 generates the label string and the label information, the user does not need to input the label string and the label information to the client device 304. Accordingly, the user can specify the desired intonation and accent more simply.

Fourth Embodiment

A fourth embodiment describes an example in which a voice synthesizer according to the present invention is applied as a voice synthesis system 400 including a sever device 402 and a client device 404 that are connected via the network 106. In the voice synthesis system 400, unlike the first to the third embodiments, a reading voice is not input. Instead, the voice synthesis system 400 generates a synthesized voice with an intonation close to that desired by the user by setting the label information very specifically.

First, the overall structure of the voice synthesis system 400 will be described with reference to FIG. 11. As can be seen from FIG. 11, the voice synthesis system 400 includes the server device 402, the client device 404 and the network 106.

The server device 402 has a generation function that generates a synthesized voice when a request is received from the client device 404. More specifically, the server device 402 receives the text that is to be generated by synthesized voice, the label string and the label information, and label frame information from the client device 404 via the network 106. The label frame information is information for setting the label information in more detail. The label information is the duration of each phoneme corresponding to each label, and a plurality of states is included for each single phoneme. This plurality of states may be states that can be distinguished based on an HMM model. By changing the duration of each state of each phoneme, it is possible to subtly adjust the intonation. The user can specify the frame number of each state of each phoneme using the client device 404 in order to change the duration of each state. The frame number of each label is a value obtained by dividing the duration of each phoneme corresponding to each label by the time interval (the frame shift length) specified by the value of the pitch or spectrum. A concrete explanation will be provided while referring to FIG. 12.

Figure 12:
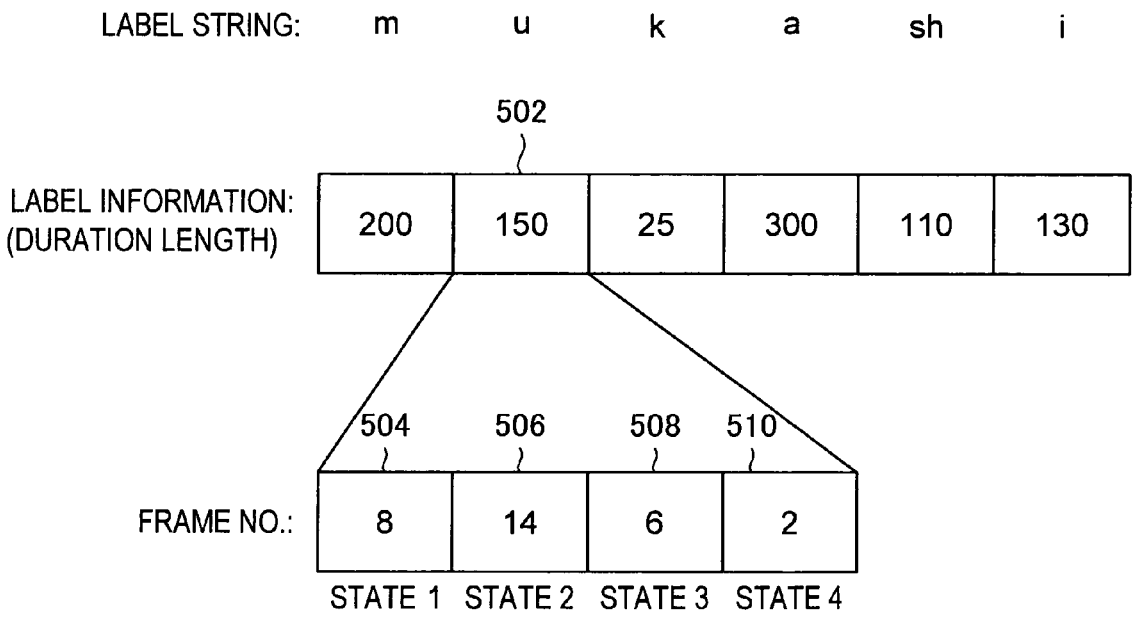
FIG. 12 is an explanatory diagram that explains a label frame according to the fourth embodiment.

In FIG. 12, the duration of label "u" is 150 milliseconds (reference numeral 502). If the frame shift length is 5 milliseconds, then, since 150 divided by 5 equals 30, 30 frames are assigned to the label "u". Based on an HMM model, the states of the phoneme corresponding to the label "u" are four, namely, states 1 to 4 . As can be seen from FIG. 12, 8 frames are assigned to state 1 (reference numeral 504), namely, state 1 has a 40 millisecond duration. Similarly, 14 frames are assigned to state 2 (reference numeral 506), 6 frames to state 3 (reference numeral 508), and 2 frames to state 4 (reference numeral 510). The user can specify a desired frame number for a desired state using the client device 404, thereby changing the frame number of each state to adjust the intonation of the synthesized voice.

The server device 402 receives the text and the label string and the label information (the attribute information) from the client device 404, and generates the synthesized voice that reads out the received text. At this time, the user can use the client device 404 to specify the above described frame number. The label information is then modified based on this specification, and the synthesized voice is then generated based on the modified label information. This completes the explanation of the overall structure of the voice synthesis system 400. Next, FIG. 11 will be used to explain the functions and structure of the client device 404 and the server device 402.

Figure 11:
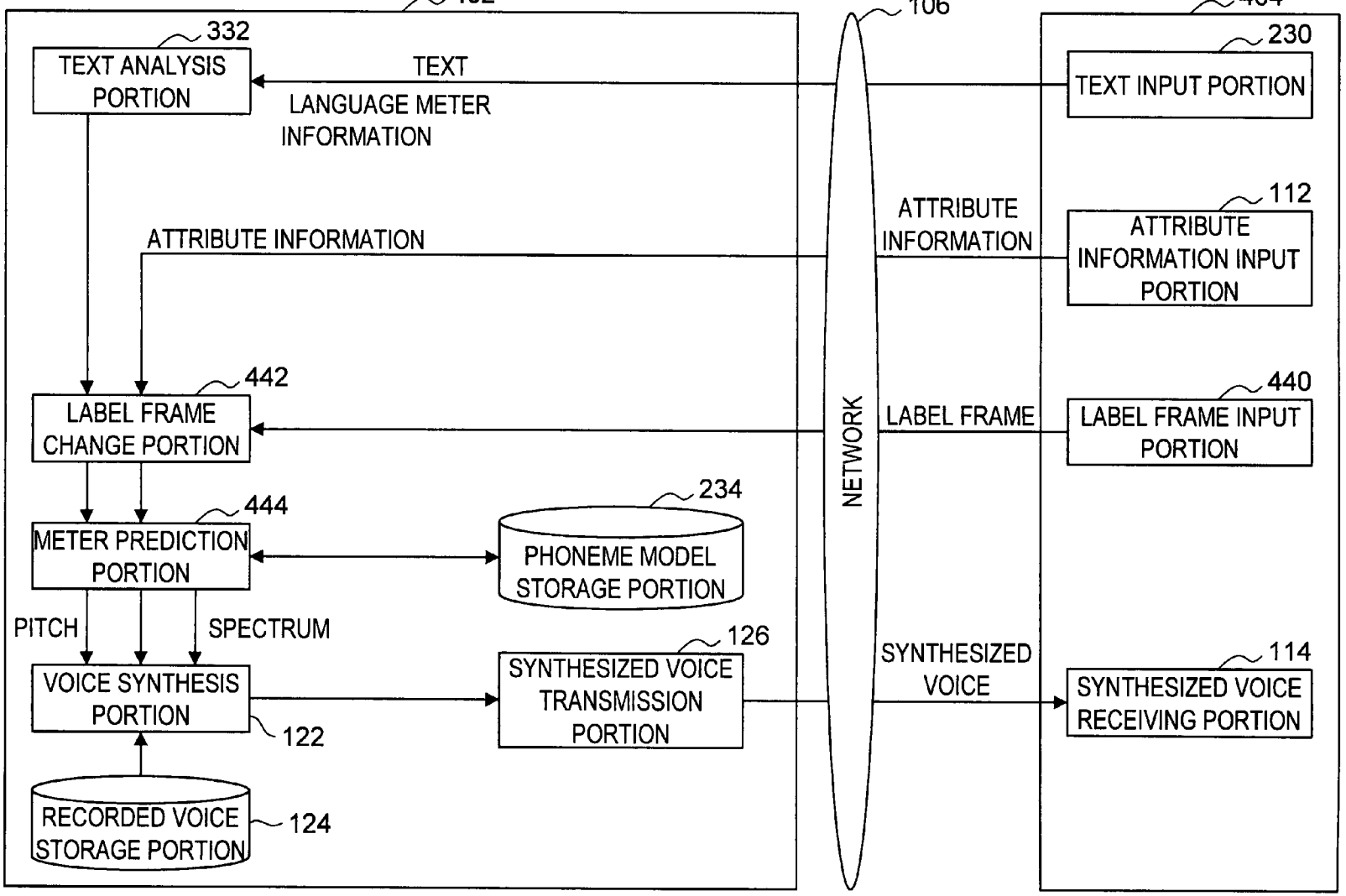
FIG. 11 is a block diagram showing a voice synthesis system according to a fourth embodiment of the present invention.

The client device 404, as shown in FIG. 11, mainly includes the text input portion 230, the attribute information input portion 112, a label frame input portion 440, and the synthesized voice receiving portion 114. The label frame input portion 440 is related to the label information input to the attribute information input portion 112. The user inputs the desired state of a desired label, and the frame number assigned to the state in to the label frame input portion 440. The label frame input portion 440 transmits the input frame number information to the server device 402. Unlike the client devices used in the first to third embodiments, no reading voice is input to the client device 404.

The server device 402 mainly includes the text analysis portion 332, a label frame change portion 442, a prosody prediction portion 444, the phoneme model storage portion 234, the voice synthesis portion 122, the recorded voice storage portion 124, and the synthesized voice transmission portion 126. The label frame change portion 442 receives the label string, the label information, and the label frame information from the client device 404, and modifies the label information based on the label frame information. As a pair, the label frame input portion 440 and the label frame change portion 442 constitute one example of a label information adjustment portion that sets the border position of each state in accordance with a plurality of states having different prosody/acoustic characteristics for the phonemes corresponding to each label.

The prosody prediction portion 444 derives an appropriate pitch and spectrum based on the language prosody information generated by the text analysis portion 332, label string and label information output from the label frame change portion 442, and the acoustic models and prosody models stored in the phoneme model storage portion 234. Other features of the server device 402 are the same as those described in the first embodiment, and thus repeated explanation will be omitted here. The server device 402, unlike the server devices used in the first to third embodiments, is not input with the reading voice from the client device 404. Instead, the server device 402 derives the pitch and the spectrum based on the input text, the label string and the label information. This completes the explanation of the functions and structure of the server device 402.

Figure 13:
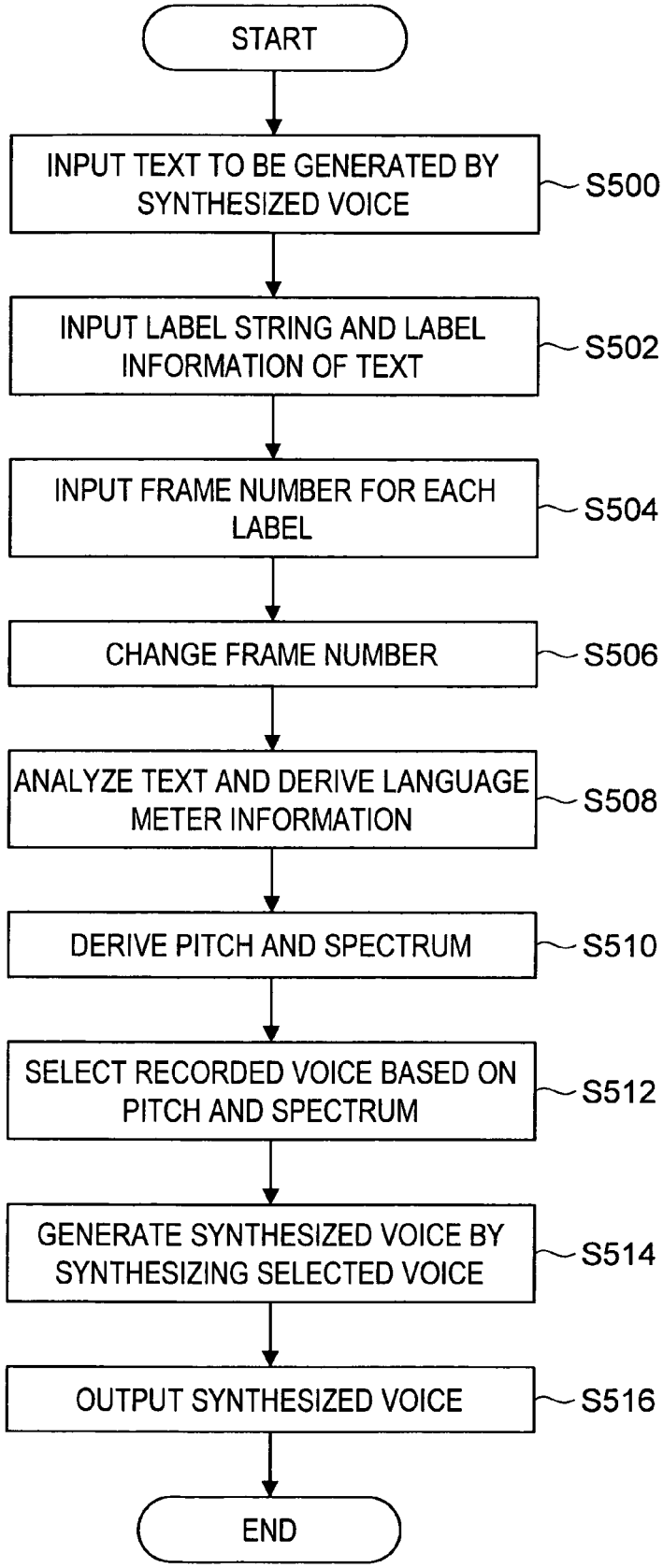
FIG. 13 is a flow chart showing voice synthesis processing according to the fourth embodiment.

Next, the flow of voice synthesis processing of the voice synthesis system 400 will be explained with reference to FIG. 13. First, the text that is to be generated by the synthesized voice is input to the voice synthesis system 400 (step S500). Then, the label string and the label information of the text input in step S500 is input to the voice synthesis system 400 (step S502). Next, the number of frames for each state for each label is input to the voice synthesis system 400 (step S504). Then, the voice synthesis system 400 modifies the label information input in step S502 based on the frame number input in step S504 (step S506). The voice synthesis system 400 then analyses the text input in step S500, and derives the language prosody information (step S508). The voice synthesis system 400 then derives the pitch and the spectrum based on label string, the label information, the language prosody information and the acoustic models and the prosody models stored in the phoneme model storage portion 234 (step S510). Following this, the voice synthesis system 400 selects recorded voices based on the derived pitch and spectrum (step S512), and synthesizes the selected voices to generate the synthesized voice (step S514) that reads out the text input in step S500. Finally, the voice synthesis system 400 outputs the generated synthesized voice (step S516).

Hereinabove, the voice synthesis system 400 according to the fourth embodiment has been explained. According to the voice synthesis system 400, the label frame number related to the synthesized voice generated by the server device 402 can be specified, thereby allowing subtle adjustment of the intonation of the synthesized voice.

Hereinabove, preferred embodiments of the present invention have been described with reference to the appended drawings. However, the present invention is not limited to these examples. As will be obvious to a person skilled in the art, the invention permits of various modifications and changes without departing from the scope of the claims. Such modifications and changes are understood to come within the scope of the present invention.

The present invention may be used as a voice synthesizer, and more particularly may be used as a voice synthesizer that uses pre-recorded voices to generate a synthesized voice that reads outs a desired text.

What is claimed is:

1. A voice synthesizer that uses recorded voices that are pre-recorded to generate a synthesized voice that reads out a text, comprising:

a recorded voice storage portion that stores the recorded voices that are pre-recorded;

a voice input portion that is input with a reading voice that is a natural voice reading out a text that is to be generated by the synthesized voice;

an attribute information input portion that is input with a label string and label information, the label string being a string of labels that are respectively assigned to each phoneme included in the reading voice and that are placed in a time series, and the label information indicating the border position of each phoneme corresponding to each label;

a parameter extraction portion that extracts a characteristic parameter that indicates a characteristic of the reading voice based on the label string, the label information, and the reading voice; and a voice synthesis portion that selects at least one of the recorded voices from the recorded voice storage portion in accordance with the characteristic parameter, synthesizes the selected at least one recorded voice, and generates the synthesized voice that reads out the text, wherein the characteristic parameter extracted by the parameter extraction portion includes a prosody parameter that indicates a prosody characteristic of the reading voice, and the voice synthesizer further comprises:

a phoneme model storage portion that stores an acoustic model and a prosody model that are generated in advance based on the recorded voices stored in the recorded voice storage portion, the acoustic model modeling an acoustic characteristic of each phoneme included in the recorded voices, and the prosody model modeling a prosody characteristic of each phoneme included in the recorded voices;

a text input portion that is input with a text that is to be generated by the synthesized voice;

a text analysis portion that analyses the text and obtains language prosody information; and a characteristic estimation portion that estimates an acoustic characteristic of the natural voice reading out the text based on the label string, the label information, the prosody parameter, the language prosody information, and the acoustic model and the prosody model stored in the phoneme model storage portion, and derives an acoustic parameter that indicates the acoustic characteristic.

2. The voice synthesizer according to claim 1, further comprising:

an individual label acoustic model storage portion that stores respective individual label acoustic models for each label that model the acoustic characteristic of each phoneme corresponding to each label; and a label information derivation portion that derives the label information based on the reading voice, the label string, and the individual label acoustic models.

3. A computer readable physical medium encoded with a computer program including computer executable instructions wherein a computer is directed to function as a voice synthesizer that uses recorded voices that are pre-recorded to generate a synthesized voice that reads out a text, comprising:

instructions to execute a voice input process in which a reading voice is input that is a natural voice reading out a text that is to be generated by the synthesized voice;

instructions to execute an attribute information input process in which a label string and label information are input, the label string being a string of labels that are respectively assigned to each phoneme included in the reading voice and that are placed in a time series, and the label information indicating the border position of each phoneme corresponding to each label;

instructions to execute a parameter extraction process that extracts a characteristic parameter that indicates a characteristic of the reading voice based on the label string, the label information, and the reading voice;

instructions to execute a selection process that selects at least one of the recorded voices in accordance with the characteristic parameter from a recorded voice storage portion that stores the recorded voices that are pre-recorded;

instructions to execute a voice synthesis process that synthesizes the at least one recorded voice selected by the selection process, and generates the synthesized voice that reads out the text;

instructions to store an acoustic model and a prosody model that are generated in advance based on the recorded voices stored in the recorded voice storage portion, the acoustic model modeling an acoustic characteristic of each phoneme included in the recorded voices, and the prosody model modeling a prosody characteristic of each phoneme included in the recorded voices;

instructions to input a text that is to be generated by the synthesized voice;

instructions to analyze the text and obtain language prosody information; and instructions to estimate an acoustic characteristic of the natural voice reading out the text based on the label string, the label information, the prosody parameter, the language prosody information, and the acoustic model and the stored prosody model, and to derive an acoustic parameter that indicates the acoustic characteristic, wherein the characteristic parameter extracted by the parameter extraction portion includes a prosody parameter that indicates a prosody characteristic of the reading voice.

4. A voice synthesizing method to be executed on a computer, which uses recorded voices that are pre-recorded to generate a synthesized voice that reads out a text, comprising the steps of:

inputting a reading voice that is a natural voice reading out a text that is to be generated by the synthesized voice;

inputting attribute information that includes a label string and label information, the label string being a string of labels that are respectively assigned to each phoneme included in the reading voice and that are placed in a time series, and the label information indicating the border position of each phoneme corresponding to each label;

extracting a characteristic parameter that indicates a characteristic of the reading voice based on the label string, the label information, and the reading voice;

selecting at least one of the recorded voices in accordance with the characteristic parameter from a recorded voice storage portion that stores the recorded voices that are pre-recorded;

generating in the computer the synthesized voice that reads out the text by synthesizing the at least one recorded voice selected in the selection step;

extracting a prosody parameter that indicates a prosody characteristic of the reading voice, storing an acoustic model and a prosody model that are generated in advance based on the recorded voices, the acoustic model modeling an acoustic characteristic of each phoneme included in the recorded voices, and the prosody model modeling a prosody characteristic of each phoneme included in the recorded voices;

inputting a text that is to be generated by the synthesized voice;

analyzing the text and obtaining language prosody information; and estimating an acoustic characteristic of the natural voice reading out the text based on the label string, the label information, the prosody parameter, the language prosody information, and the acoustic model and the prosody model, and deriving an acoustic parameter that indicates the acoustic characteristic.

5. A voice synthesizer that uses recorded voices that are pre-recorded to generate a synthesized voice that reads out a text, comprising:

a recorded voice storage portion that stores the recorded voices that are pre-recorded;

a phoneme model storage portion that stores an acoustic model and a prosody model that are generated in advance based on the recorded voices stored in the recorded voice storage portion, the acoustic model modeling an acoustic characteristic of each phoneme included in the recorded voices, and the prosody model modeling a prosody characteristic of each phoneme included in the recorded voices;

a text input portion that is input with a text that is to be generated by the synthesized voice;

an attribute information input portion that is input with a label string and label information, the label string being a string of labels that are respectively assigned to each phoneme included in the reading voice and that are placed in a time series, and the label information indicating the border position of each phoneme corresponding to each label;

a label information adjustment portion that sets, in accordance with a plurality of metrically and/or acoustically different states of each phoneme, the border position of each state;

a text analysis portion that analyses the text and obtains language prosody information;

a characteristic estimation portion that estimates a characteristic of the natural voice reading out the text based on the label string, the label information adjusted by the label information adjustment portion, the language prosody information, and the acoustic model and the prosody model stored in the phoneme model storage portion, and derives a characteristic parameter that indicates the characteristic; and a voice synthesis portion that selects at least one of the recorded voices from the recorded voice storage portion in accordance with the characteristic parameter, synthesizes the selected at least one recorded voice, and generates the synthesized voice that reads out the text.

6. The voice synthesizer according to claim 5, wherein the label information indicates a duration of each phoneme corresponding to each label, and the label information adjustment portion assigns the durations to each state in correspondence with the plurality of states.

7. A computer readable physical medium encoded with a computer program including computer executable instructions wherein a computer is directed to function as a voice synthesizer that uses recorded voices that are pre-recorded to generate a synthesized voice that reads out a text, the computer program using:

a recorded voice storage portion that stores the recorded voices that are pre-recorded; and a phoneme model storage portion that stores an acoustic model and a prosody model that are generated in advance based on the recorded voices stored in the recorded voice storage portion, the acoustic model modeling an acoustic characteristic of each phoneme included in the recorded voices, and the prosody model modeling a prosody characteristic of each phoneme included in the recorded voices, and comprising:

instructions to execute a text input process in which a text is input that is to be generated by the synthesized voice;

instructions to execute an attribute information input process in which a label string and label information are input, the label string being a string of labels that are respectively assigned to each phoneme included in the text and that are placed in a time series, and the label information indicating the border position of each phoneme corresponding to each label;

instructions to execute a label information adjustment process that sets, in accordance with a plurality of metrically and/or acoustically different states of each phoneme, the border position of each state;

instructions to execute a text analysis process that analyses the text and obtains language prosody information;

instructions to execute a characteristic estimation process that estimates a characteristic of the natural voice reading out the text based on the label string, the label information adjusted by the label information adjustment process, the language prosody information, and the acoustic model and the prosody model stored in the phoneme model storage portion, and derives a characteristic parameter that indicates the characteristic; and instructions to execute a voice synthesis process that selects at least one of the recorded voices from the recorded voice storage portion in accordance with the characteristic parameter, synthesizes the at least one selected recorded voice, and generates the synthesized voice that reads out the text.

8. A voice synthesizing method to be executed on a computer, which uses recorded voices that are pre-recorded to generate a synthesized voice that reads out a text, the method using:

a recorded voice storage portion that stores the recorded voices that are pre-recorded; and a phoneme model storage portion that stores an acoustic model and a prosody model that are generated in advance based on the recorded voices stored in the recorded voice storage portion, the acoustic model modeling an acoustic characteristic of each phoneme included in the recorded voices, and the prosody model modeling a prosody characteristic of each phoneme included in the recorded voices, and comprising the steps of:

inputting a text that is to be generated by the synthesized voice; inputting attribute information that includes a label string and label information, the label string being a string of labels that are respectively assigned to each phoneme included in the text and that are placed in a time series, and the label information indicating the border position of each phoneme corresponding to each label;

adjusting the label information by setting, in accordance with a plurality of metrically and/or acoustically different states of each phoneme, the border position of each state;

analyzing the text and obtaining language prosody information;

estimating a characteristic of the natural voice reading out the text based on the label string, the label information adjusted by the label information adjustment step, the language prosody information, and the acoustic model and the prosody model stored in the phoneme model storage portion, and deriving a characteristic parameter that indicates the characteristic; and generating in the computer the synthesized voice that reads out the text by selecting at least one of the recorded voices from the recorded voice storage portion in accordance with the characteristic parameter and synthesizing the selected at least one recorded voice.

* * * * *